US005642919A

United States Patent [19]

Gioacchini

[11] Patent Number: 5,642,919

[45] Date of Patent: Jul. 1, 1997

[54] MODULAR UNIT AND METHOD FOR PRODUCING SEATS

[75] Inventor: Nilo Gioacchini, Pelago, Italy

[73] Assignee: Castelli S.p.A., Dell'Emilia, Italy

[21] Appl. No.: 650,031

[22] Filed: May 17, 1996

Related U.S. Application Data

[63] Continuation of Ser. No. 160,822, Dec. 3, 1993, abandoned.

[30] Foreign Application Priority Data

Dec. 4, 1992 [IT] Italy ..... BO92A0427

[51] Int. Cl.[6] ..... A47C 1/12

[52] U.S. Cl. ..... 297/451.8; 297/440.14

[58] Field of Search ..... 297/440.14, 440.1, 297/440.15, 440.22, 440.24, 452.16, 451.8, 445.1, 449.1; 403/217, 219; 411/63, 65

[56] References Cited

U.S. PATENT DOCUMENTS

| | | | |
|---|---|---|---|
| 786,846 | 4/1905 | Seamans | 403/217 |
| 3,230,909 | 1/1966 | Watson | 297/440.14 X |
| 3,450,435 | 6/1969 | Stephens | 297/452.16 X |
| 4,021,128 | 5/1977 | Chiames | 403/217 |
| 4,208,072 | 6/1980 | Iskendarian | 297/440.22 X |
| 4,603,903 | 8/1986 | Moscovitch | 297/440.1 X |
| 4,760,802 | 8/1988 | Leong | 108/157 |
| 4,799,735 | 1/1989 | Meyer | 297/440.1 |
| 5,230,491 | 7/1993 | Tseng | 403/217 X |

FOREIGN PATENT DOCUMENTS

| | | | |
|---|---|---|---|
| 0399894 | 11/1990 | European Pat. Off. . | |
| 929238 | 12/1947 | France | 297/440.14 |
| 627318 | 2/1963 | France | 411/63 |
| 2535962 | 5/1984 | France . | |

*Primary Examiner*—Milton Nelson, Jr.

*Attorney, Agent, or Firm*—Sughrue, Mion, Zinn, Macpeak & Seas

[57] ABSTRACT

A modular unit for assembling seats comprises a plurality of elements which are spatially complementary and can be grouped together about an axis. The elements can be associated with respective portions of the seat to be produced and are rigidly connected together by a screw which can extend through a longitudinal hole formed jointly by grooves in the elements. The rotation of the screw causes a transverse sliding of two locking elements having inclined surfaces which cooperate with respective sloped portions of the elements in order to urge the elements into a state in which they are assembled about the axis. The elements may be of integral construction with portions of the seat such as a seat portion, an armrest portion or a leg portion.

10 Claims, 4 Drawing Sheets

MODULAR UNIT AND METHOD FOR PRODUCING SEATS

This is a continuation of application Ser. No. 08/160,822 filed Dec. 3, 1993, now abandoned.

BACKGROUND OF THE INVENTION

The present invention relates to a modular unit as well as to a method for producing seats. As will become clear from the description, according to the meaning which is becoming increasingly wide-spread in furnishing, the term "seat" is understood as indicating all types of furniture, such as chairs, armchairs, theatre seats, sofas, stools, etc., of which the main purpose is to act as a supporting structure for one or more persons in a seated position.

The invention has been developed with particular respect to the method of producing seats comprising modular component elements intended to provide, from a base module, variants having different functional and structural characteristics.

For example, seats are known to which it is possible, beginning with a base module, to add details which modify its aesthetic, functional and structural characteristics. For example, it is possible to add accessories such as armrests and writing tables to the base modules of the known seats, or to modify their type of support, changing from a seat structure which is independently mounted on legs to multiple seats ill a line supported by a common supporting bar. The functional or structural modification of the seat is usually brought about by the fitting of additional features on the basic seat, the elements being superposed subsequently in order to obtain the required model of seat.

The production of seats by the known method has two main disadvantages: firstly, the addition of the features by superposition increases the overall size of the seat, while the space available for seating remains constant; secondly, the operation for fitting the accessories or for modifying the features of the seat is lengthy and costly, one feature having to be added at a time and each of them requiring intervention on its own connection system, such as, for example, the locking of the connection screws to the base structure of the seat.

The reduction in the ratio between the useful seating space and the maximum size of the seat is particularly undesirable in the case in which stalls are to be installed, for example, in meeting rooms, auditoria, theatres and the like. In such a case, an increase of the maximum size of each seat by a few centimetres causes an appreciable reduction in the number of places which can be provided in these rooms. Further, in the case in which these rooms are already fitted with particular seat models, for example, the base models, it is practically impossible to modify their features, for example, by the addition of accessories such as armrests, without dismantling the entire installation.

SUMMARY OF THE INVENTION

The object of the present invention is to overcome the disadvantages of the prior art, at the same time enabling seats to be produced with modular elements which can be modified simply and economically, even using unskilled personnel.

This object is achieved by means of a modular unit which comprises a plurality of spatially complementary elements, which can be grouped together about an axis and at least some of which can be associated with respective portions of the above-mentioned seats, and connection means for rigidly connecting the elements together.

A further object of the present invention is to provide operations for modifying the various seat models by means of a method for producing the required seat model quickly and economically.

The present invention also benefits from the known advantages of the design, production and sale of generally modular component elements, such as, for example, the reduction in time for developing new seat models having different aesthetic features but identical structural components, the reduction of shop stocks, or of the supply and order times for the various modules suitable for the production of different seat models.

A further advantage is derived from the fact that with the present invention the ratio between the useful seating space and the maximum size of the seat itself is optimised. The ratio remains constant for various models of seat, independently number and of the type of accessories or structural features with which it is provided. This advantage is particularly noticeable in the area of the design or maintenance of areas where there is a plurality of seats, since, on the one hand, it allows the maximum number of seating places to be calculated independently of the seat model actually adopted later, and, on the other hand, it enables entire existing stalls to be updated and modified without intervention on the initial layout being necessary and without the updating resulting in a reduction in the number of places originally available.

BRIEF DESCRIPTION OF THE DRAWINGS

Further characteristics and advantages of the invention will become clear from the following description, with reference to the appended drawings, provided purely by way of non-limiting example and in which.

DETAILED DESCRIPTION OF THE INVENTION

Figure 1:
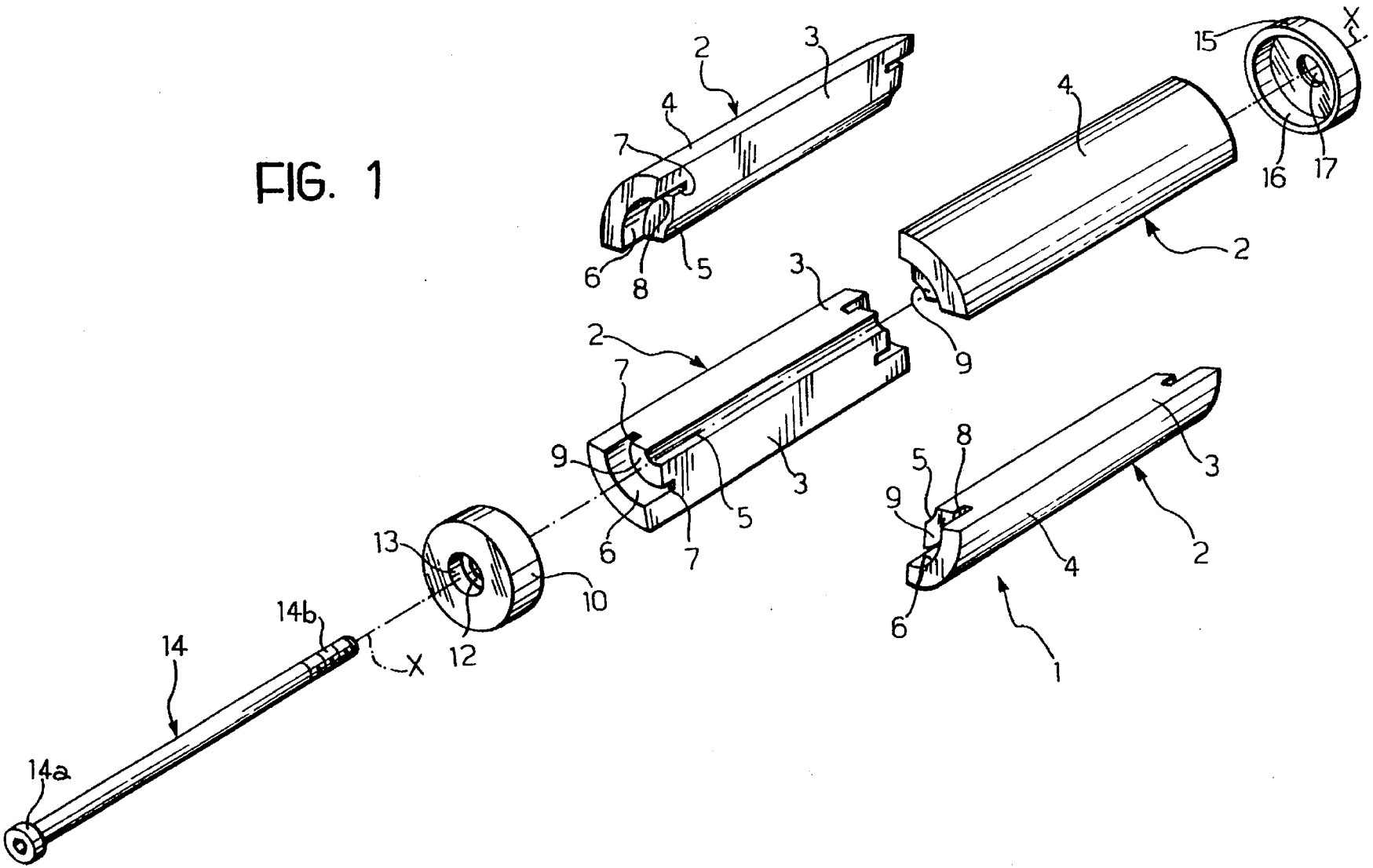
FIG. 1 is an exploded perspective view of the modular unit according to the present invention.
Figure 2:
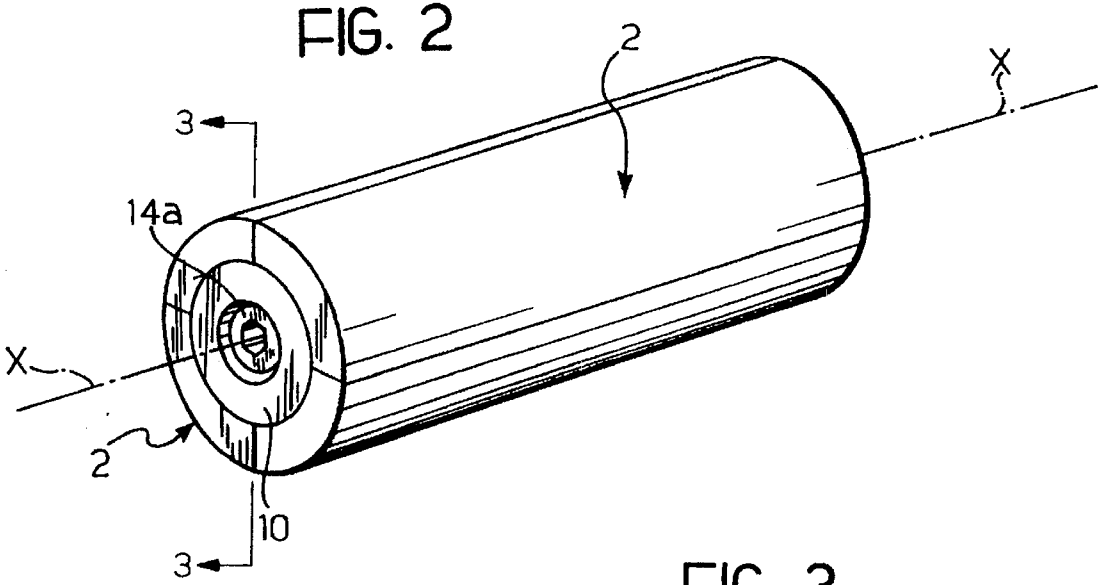
FIG. 2 is a perspective view of the modular unit of FIG. 1 in the assembled configuration.
Figure 3:
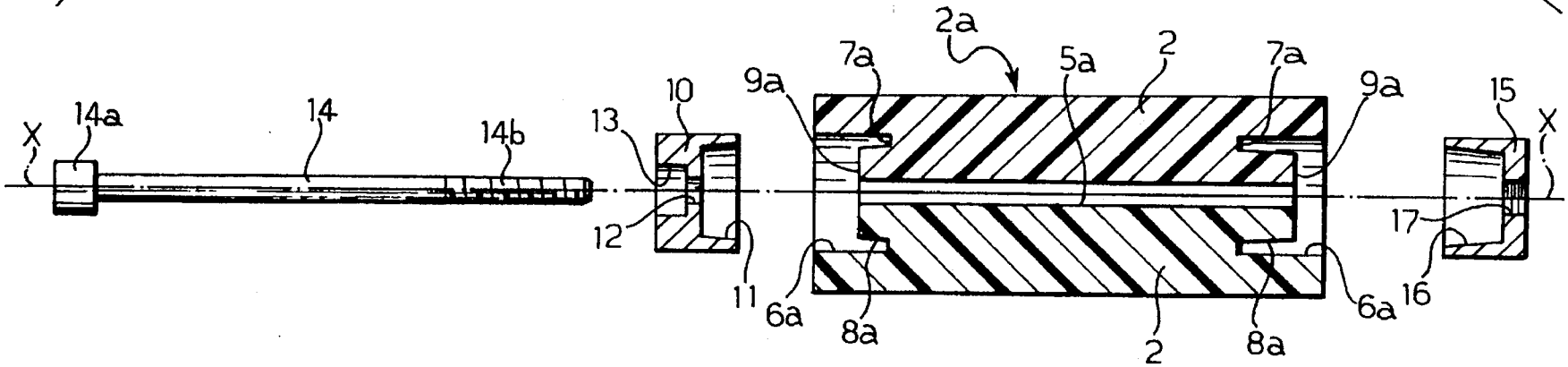
FIG. 3 is a partially exploded longitudinal section of the modular unit of FIG. 1.

With reference to FIGS. 1 to 3, a modular unit generally indicated 1 is shown schematically, and, comprises, in the embodiment illustrated, four sectors of cylinders 2 which are symmetrical relative to an axis, indicated X—X in the drawings, and each having two longitudinal faces 3 which are at right angles to one another, and an outer curved surface 4. In the assembled state, shown in FIG. 3, the longitudinal faces 3 of adjacent sectors have been brought near such that all the sectors, grouped together about the axis X—X (assembly axis), form a cylindrical body 2*a* with an axis coinciding exactly with the axis X—X. A longitudinal groove 5 having a quarter circular cross-section, of which the centre lies on the axis of the vertex of each sector 2, is provided in correspondence with this axis. In the assembled state, these grooves together form a cylindrical hole 5*a* which passes longitudinally from one side of the cylinder 2*a* to the other.

On the end face of each sector 2 are two grooves which also have a generally quarter circle shape and have an outer wall 6 with generatrices parallel to the curved surface 4 of the respective sector, a base wall 7, substantially perpendicular to the axis of the vertex of the sector 2, and a conical inner wall 8, the generatrices of which are inclined relative to the curved surface 4 such that they form inclined portions along the axis X—X. In general, the assembly of the walls 6, 7 and 8 forms, in the assembled configuration of FIGS. 2 and 3, a cylindrical cavity 6*a* having an annular base 7*a* and a frustoconical body 8*a* which projects relative to the base 7*a*. The small base 9*a* of the frustoconical body 8*a*, formed by all the sector faces 9 of the annular ring of sectors 2, extends from the base 7*a* for a length which is less than the depth of the cavity 6*a*.

A first cylindrical body 10 having a diameter equal to the diameter of one of the two cavities 6*a* (on the lefthand side in FIG. 3) has a frustoconical cavity 11 with a taper equal to the taper of the corresponding frustoconical body 8*a*. The maximum diameter of the cavity 11, at its mouth, is slightly greater than the smallest diameter of the corresponding frustoconical body 8*a* and yet is smaller than the maximum diameter of the frustoconical body 8*a*. The cavity 11 communicates by means of a hole 12 with a cylindrical seat 13 which faces the face of the cylindrical body 10 opposite the face on which the cavity 11 opens. The seal 13 is intended to house the head 14*a* of a locking screw 14.

A second cylindrical body 15 also has a frustoconical cavity 16 with a taper equal to the taper of the other of the two cavities 6*a* (on the righthand side in FIG. 3). The dimensional characteristics of the diameters of the cavity 16 reflect what has already been described with reference to the cavity 11 of the cylindrical body 10. In the base of the cylindrical body 15 is a threaded hole 17 intended to be coupled with the threaded end 14*b* of the locking screw The modular unit 1 is assembled as a result of the sectors 2 being brought together, as described above, to form the cylindrical body 2*a*, and as a result of the cylindrical bodies 10 and 15 being inserted successively in the cylindrical cavity 6*a*, on the lefthand side and on the righthand side respectively in FIG. 3. Subsequently, the locking screw 14 is inserted in the hole 12 in the first cylindrical body 10 and in the hole 5*a* in the body 2*a*, until the threaded end 14*b* engages with the threaded hole 17 of the second cylindrical body 15. The screw 14 is thus tightened by action on its head 14*a* with a screwdriver of a known type, effecting the sliding of the conical surfaces of the cavities 11, 16 on the respective frustoconical bodies 8*a*. This sliding effects the forced locking of the sectors 2 one against the other, in order to produce a compact and rigid structure, shown in FIG. 2, which can, however, be rapidly and easily released by unscrewing the screw 14 and removing the cylindrical bodies 10, 15.

Figure 4:
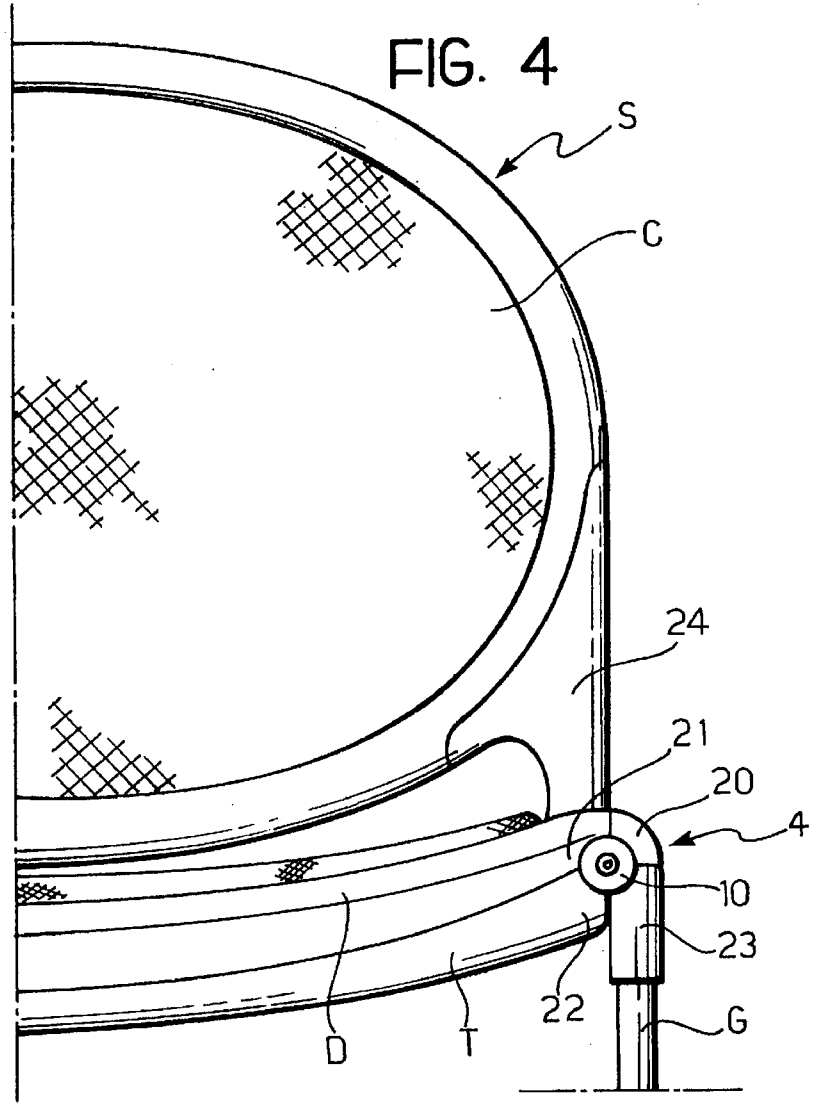

With reference to FIG. 4, a first embodiment of a seat is shown, comprising the four cylinder sectors 2, numbered 20, 21, 22 and 23 for greater clarity. Each of the sectors can be integrally associated with a respective element which helps to form the seat S. In particular, the sector 21 is integrally connected to a supporting unit 24 of the squab D and of the backrest C of the seat S. Variants of the supporting unit 24 can be provided according to the seat models which are to be produced, these can be tip-up seats, seats with adjustable backs, and the like. The sector 22 bears a reinforcing crossbar T which connects the modular unit 1 to a modular unit symmetrically disposed on the other side of the seat S. The sector 23 is in turn integral with an upright support or leg unit G of the seat S. In the seat model illustrated in FIG. 4, the sector 20 is provided in its base form and the curved surface 4 constitutes a finishing element for the edge of the seat S.

Figure 5:
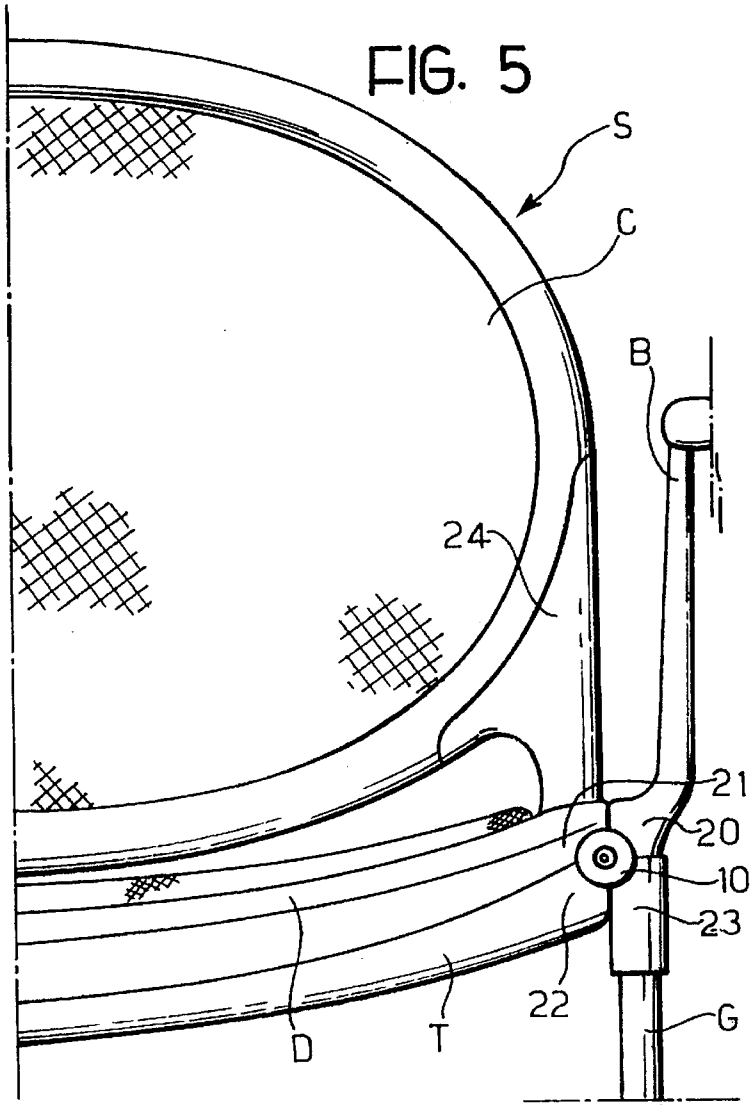
FIG. 4, 5, 6 and 7 illustrate four different variants of seat models produced by using the modular unit of FIG. 1.

FIG. 5 shows a variant of the seat S in which the sector 20 is integral with an armrest B which helps to modify the general appearance of the seat S and the operating features. It will be appreciated that, instead of the armrest B, it is possible to provide some other side accessory of a known type, such as, for example, a writing table or the like.

Figure 6:
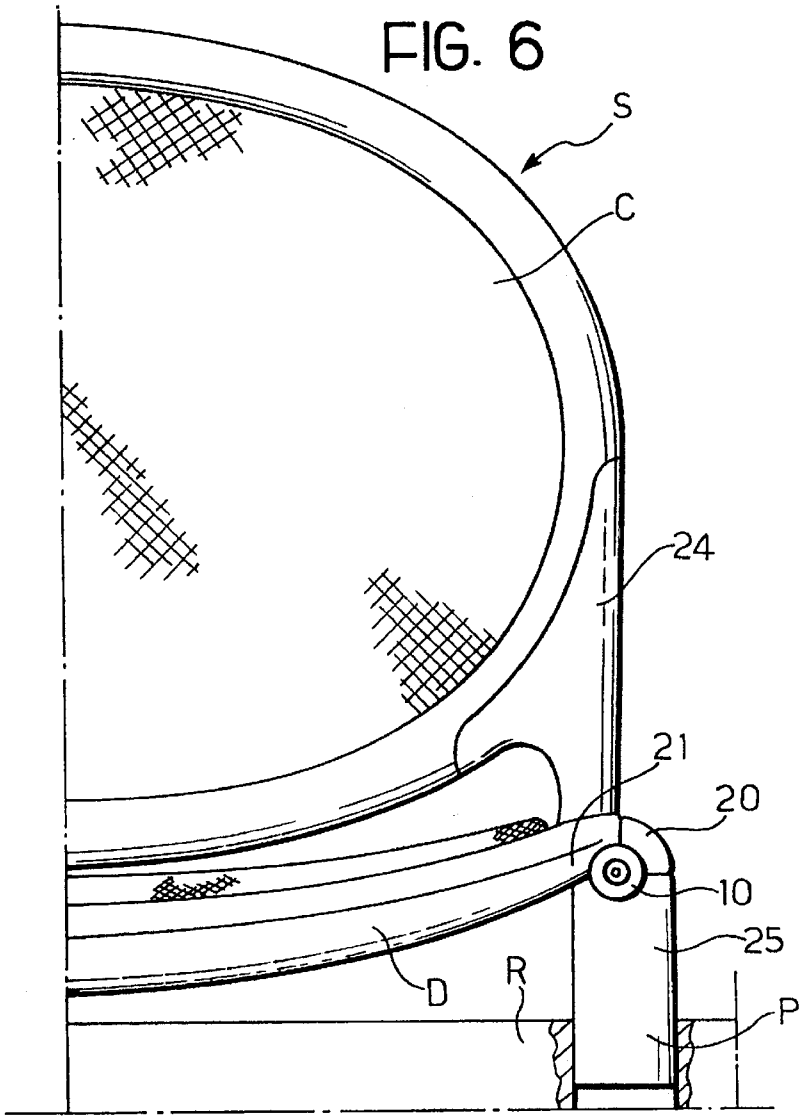

FIG. 6 shows a third variant of the seat S, which can in particular be used to produce an array of many seats in a line. In this variant, instead of two lower sectors (22 and 23 in FIGS. 4 and 5), a single semicylindrical sector 25 is provided which is integral with an upright support P which is to be fixed in known manner to a horizontal supporting bar R. In its base form, the sector 20 constitutes a side finishing component for the seat S similar to what was described in relation to FIG. 4.

Figure 7:
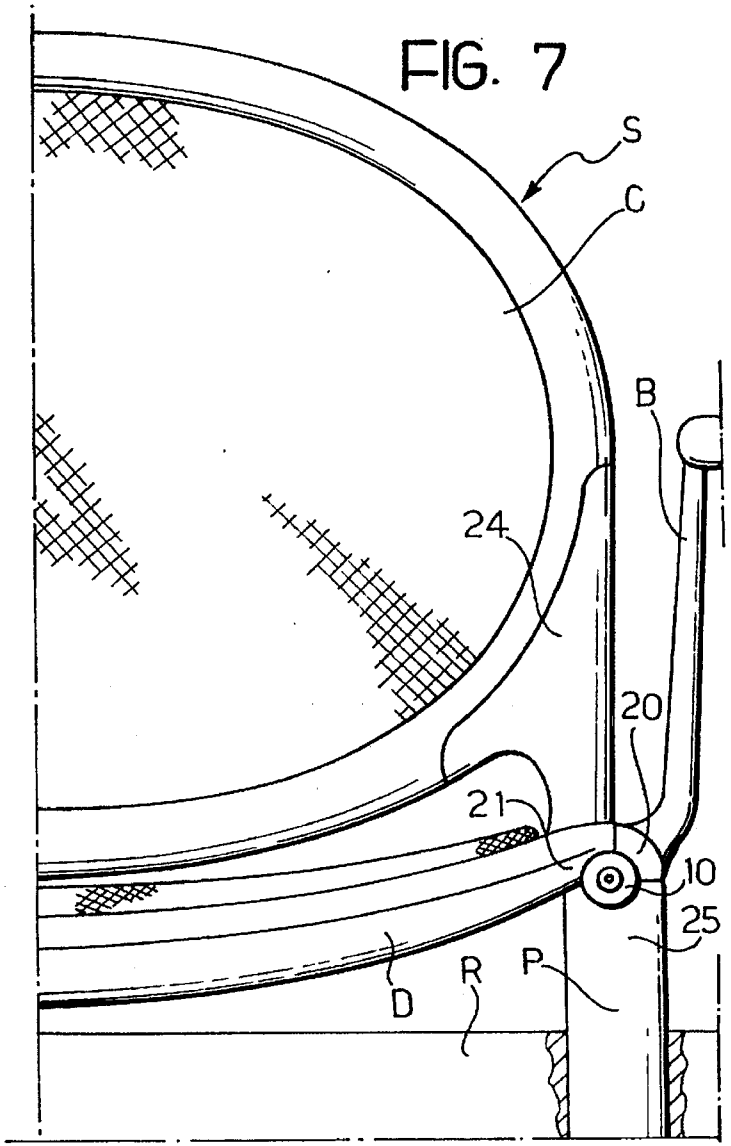

FIG. 7 shows a further variant of the seat S for producing an array of seats similar to those in FIG. 6, in which the sector 20 is integral with the same armrest B shown in FIG. 5.

Naturally, the principle of the invention remaining the same, the forms of embodiment can be widely varied without departing from the scope of the present invention. In particular, the number and arrangement of the cylindrical sectors 2 about the axis X—X is not restricted to that which has been illustrated.

Even the preferred embodiment illustrated in the Figures which provides for the production of cylinder sectors is not restrictive, since the shape of the outer surface of each sector 2 is dictated solely by ornamental considerations, prismatic or other shapes which can be arranged about a common axis, can also be provided without departing from the scope of the present invention.

For example, FIGS. 1 to 3 show schematically a preferred arrangement and the operating principle of the modular unit which is the subject of the present invention. Variants for improving the operating and structural characteristics of the modular unit 1 can easily be provided. For example, centering dowels can be provided and the respective seats displaced on their longitudinal surfaces 3 to assist the correct assembly and connection of the sectors 2. A further variant can provide grooves and projections on the outer faces of the cylindrical bodies 10, 15, so as to assist their removal when the modular unit 1 is dismantled.

It is further possible to envisage forming the modular unit with complementary elements of a number differing from the number which can be deduced from the embodiments given, the general feature of these elements regarding the possibility of being grouped together remaining unchanged.

What is claimed is:

1. A modular unit for use as part of a seat assembly including seat portions, the modular unit comprising:

a plurality of spatially complementary elongated elements having opposite end portions, said complementary elements when grouped together forming a member having a longitudinal axis; and connection means for rigidly connecting adjacent end portions of said complementary elements together to form said member;

wherein at least some of said complementary elements are capable of being associated with seat portions of the seat assembly;

wherein each said complementary element includes means defining a longitudinal groove extending from one end portion to an opposite end portion such that when said complementary elements are grouped together to form said member, said longitudinal grooves communicate and define a longitudinal through hole extending along said axis;

wherein said end portions of each complementary element has two end faces at opposite ends thereof and each said end face has an inclined portion, each said inclined portion being inclined generally in the direction of said axis;

and wherein said connection means comprises a pair of locking elements, said locking elements having at least one surface which is inclined relative to said axis and which is capable of co-operating with said inclined portions of said complementary elements when said complementary elements are grouped together into said member in order to connect said complementary elements to form said member.

2. A modular unit according to claim 1, wherein said connection means further comprises a screw, said screw being capable of extending through the longitudinal hole defined by said complementary elements when they are grouped together to form said member, said screw having two ends, said locking elements being capable of co-operating with said ends of said screw such that rotation of the screw results in relative sliding of the locking elements therealong, said inclined portions and inclined surfaces being capable of co-operating such that a tightening rotational action exerted on the screw urges the complementary elements together into an arrangement about said axis.

3. A modular unit according to claim 2, wherein each said complementary element includes means defining a groove in each said end face such that when said complementary elements are grouped together to form said member said groove defining means communicate and together define a substantially annular groove, said groove defining means including walls and each said inclined portion comprising a said wall.

4. A modular unit according to claim 3, wherein each said locking element comprises a cylindrical body defining a frustoconical cavity and a screw receiving axial hole therein, whereby, when said complementary elements are grouped together into said member said inclined portions form a frustoconical body at each end of said member with a taper equal to the taper of the frustoconical body, one of said holes being a screw threaded hole complementary to a threaded end of said screw.

5. A seat assembly comprising:

a pair of members each having a longitudinal axis, said members being disposed on opposite sides of said seat assembly with said longitudinal axes thereof disposed substantially horizontal;

each member comprising a plurality of spatially complementary elements;

connection means connecting said complementary elements of each member together to form said member;

a pair of upright support means connected to a first element of each member respectively;

a pair of squab supporting means connected to a second element of each member respectively; and a squab connected to and extending between said squab supporting means.

6. A seat assembly according to claim 5, wherein each said complementary element includes means defining a longitudinal groove to thereby define together a longitudinal hole along said axis.

7. A seat assembly according to claim 6, wherein said member has two opposed end faces and each said end face has an inclined portion, which extends over each said complementary element, each said inclined portion being inclined generally in the direction of said axis;

and wherein said connection means comprises a pair of locking elements, each said locking element having a surface which is inclined relative to said axis and which is capable of co-operating with a said inclined portion of said member.

8. A seat assembly according to claim 7, wherein said connection means further comprises a screw, said screw being capable of extending through the longitudinal hole defined by said member, said screw having two ends, said locking elements being capable of co-operating with said ends of said screw such that rotation of the screw results in relative sliding of the locking elements therealong, said inclined portions and inclined surfaces being capable of co-operating such that a tightening rotational action exerted on the screw urges the complementary elements together.

9. A seat assembly according to claim 8, wherein said member includes means defining a substantially annular groove, said groove defining means including walls and each said inclined portion comprising a said wall.

10. A seat assembly according to claim 9, wherein each said locking element comprises a cylindrical body defining a frustoconical cavity and a screw receiving axial hole therein, whereby, said inclined portions form a frustoconical body at each end of said member with a taper equal to the taper of the frustoconical cavity defined in each said cylindrical body, one of said holes being a screw-threaded hole complementary to a screw-threaded end of said screw.

* * * * *